United States Patent [19]

Haeusser et al.

[11] Patent Number: 4,757,570

[45] Date of Patent: Jul. 19, 1988

[54] TOOTHBRUSH FOR SIMULTANEOUS CLEANING OF TEETH ON BOTH SIDES

[76] Inventors: Manfred Haeusser, Moosbronner Strasse 14, D-7506 Bad Herrenalb 3; Konstantin Wolpalka, D-7506 Bad Herrenalb 1, both of Fed. Rep. of Germany

[21] Appl. No.: 19,593

[22] PCT Filed: Jun. 14, 1986

[86] PCT No.: PCT/EP86/00354

§ 371 Date: Feb. 18, 1987

§ 102(e) Date: Feb. 18, 1987

[87] PCT Pub. No.: WO86/07527

PCT Pub. Date: Dec. 31, 1986

[30] Foreign Application Priority Data

Jun. 18, 1985 [CH] Switzerland ..... 2576/85

[51] Int. Cl.[4] ..... A46B 9/04

[52] U.S. Cl. ..... 15/167.2; 15/144 R; 15/167.1

[58] Field of Search ..... 15/167 R, 167 A, 203, 15/144 R, 172

[56] References Cited

U.S. PATENT DOCUMENTS

| | | | |
|---|---|---|---|
| 1,679,946 | 8/1928 | Ruff . | |
| 2,244,615 | 6/1941 | Garcin | 15/167 A |
| 3,188,672 | 6/1965 | Gary . | |
| 4,115,894 | 9/1978 | Peterson . | |
| 4,366,592 | 1/1983 | Bromboz | 15/167 A |
| 4,428,091 | 1/1984 | Janssen | 15/167 A |

FOREIGN PATENT DOCUMENTS

| | | | |
|---|---|---|---|
| 825536 | 11/1951 | Fed. Rep. of Germany . | |
| 1126824 | 7/1956 | France | 15/167 A |
| 1203916 | 1/1960 | France . | |
| WO82/00406 | 2/1982 | PCT Int'l Appl. . | |
| WO84/00684 | 3/1984 | PCT Int'l Appl. | 15/167 A |
| 155730 | 7/1932 | Switzerland . | |
| 179403 | 9/1935 | Switzerland . | |
| 401903 | 5/1966 | Switzerland . | |

*Primary Examiner*—Peter Feldman

*Attorney, Agent, or Firm*—Cushman, Darby & Cushman

[57] ABSTRACT

The toothbrush for cleaning both sides of the teeth simultaneously consists of a handle (1) with at least one bristle holder (3, 4) of U-shaped cross section, the legs of said U-shaped cross section having bristles (6) facing inward. Relative to the bristle holder (3, 4) the handle (1) is constructed pivotally about an axis (7) which when the toothbrush is being used is parallel to the axis of the body, and/or relative to the web (2) at least one bristle holder (3 or 4) is pivotal about an axis (8) which is parallel to the teeth when the toothbrush is being used. The bristles (6) are inclined forward and backward away from the web (2) at an angle $\alpha$ of preferably 3° to 5°, as well as additionally or alternatively in the direction in which the toothbrush is pushed at an angle of $\beta$ of preferably 8° to 10° seen from the middle of the web.

3 Claims, 1 Drawing Sheet

TOOTHBRUSH FOR SIMULTANEOUS CLEANING OF TEETH ON BOTH SIDES

Figure 1:
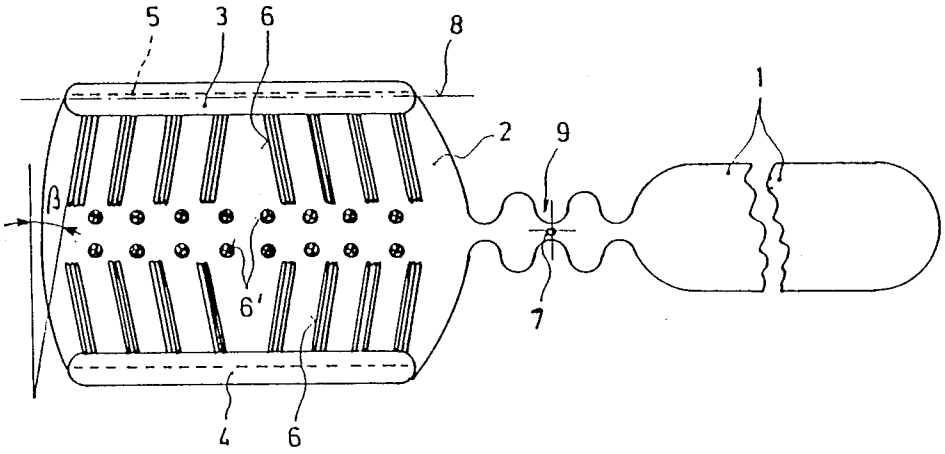

The invention relates to a toothbrush for the purpose of cleaning both sides of the teeth simultaneously, said toothbrush consisting of a handle with U-shaped bristle holders formed thereupon that are connected by a web, said bristle holders having bristles that face inward.

Such a toothbrush serves to simultaneously clean the front and rear sides of the teeth in a single brushing stroke, eventually even simultaneously the teeth of the upper jaw and the lower jaw together.

Such a toothbrush has become known from DE-PS No. 825 536. In this case, in the longitudinal direction the bristle holders are shaped to match the jaw curvature. The bristles themselves stand out straight from (perpendicular to) the holder.

The disadvantage of this embodiment is that it constitutes a rigid structure, and in addition that such a bristle holder fits only a specific curvature of the jaw. For this reason, such a toothbrush is not usable generally, and has not found acceptance. It is conceivable that toothbrushes of different sizes, e.g. for children and adults, to be made, which however does not achieve the desired success because in shape jaws and teeth differ greatly. In the rigid configuration of the bristle part the conventional, relatively sharp-edged construction of the bristle tips is of great disadvantage because as opposed to a toothbrush which can only be used only on one side the pressure acting on the teeth and hence on the gums can be adjusted individually.

Proceeding from this state of the art the objective of the present invention was to device a toothbrush of only one size suitable for the diverse jaw and tooth shapes. According to the present invention this object is achieved in that in the usage position, relative to the bristle holder the handle is pivotal about an axis lying parallel to the body and/or in the usage position relative to the web at least one bristle holder is pivotal about an axis parallel to the teeth.

In the aforementioned DE-PS a pivotal articulated connection of the bristle part on the handle has already been disclosed, but it is by no means apparent in which direction the pivoting is to be given. And its purpose is to facilitate the cleaning of dentures, which doubtlessly involves other requirements.

Since the thicknesses of teeth in their embedment in the jaw, and with them the thickness of the gum, vary, just as individual jaw curvatures differ greatly greatly it is expedient for this pivotability to be effected elastically, which can be accomplished by the selection of a suitable material of which the bristle holder and the handle consist, or by an appropriate weakening of the material resulting in rated flexure points.

In the case of the toothbrush according to the present invention which compulsively provides for a certain distance between the two legs of the U, and between the tips of the bristle projecting from the inside of said legs, for more effective removal of the plaque by pushing action and for improved massaging of the gums it is expedient for the bristles on the bristle holders on both sides to be inclined away from the web at an angle of about 1° to about 10°, preferably 3° to 5°, and/or for the bristles to be inclined backward and forward in the direction in which the toothbrush is pushed by about 3° to 15°, preferably 8° to 10°, viewing from the middle of the web.

By this special embodiment of a toothbrush it is achieved that a toothbrush of a single size can be used for all tooth and jaw shapes. Especially a good cleaning effect is achievable by the specific arrangement of the bristles.

On the basis of an example of an embodiment the invention is described in greater detail. Shown are:

FIG. 1 a side view of a toothbrush

Figure 2:
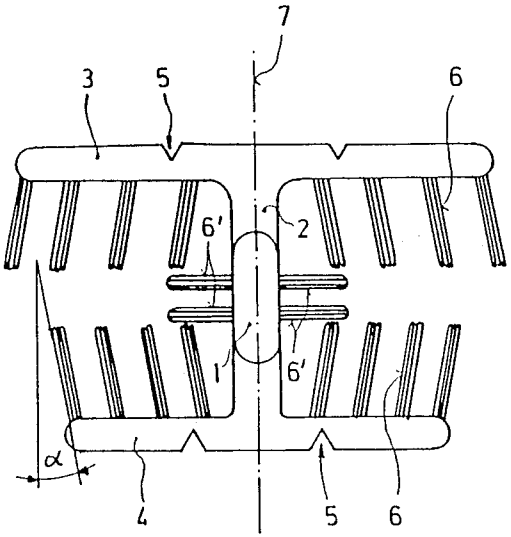

FIG. 2 the cross-sectional shape thereto.

In the side view FIG. 1 shows the toothbrush cited as an example of an embodiment. A flat, high web 2 closed off at the top and bottom by bristle holder 3 and 4 respectively is arranged on a handle 1. These bristle holders 3 and 4 are arranged perpendicularly above and below the web 2, producing a double U-shaped or quasi I-shaped part as shown more illustratively in FIG. 2.

However, important for an intensive cleaning process is the position of the bristles 6. These bristles are not arranged straight, e.g. at a right angle to the bristle holders 3, 4, but at an inclination. As an extensive test series has shown it is of advantage for the bristles 6 in the bristle holders 3, 4 to be arranged pointing away from the web 2 on both sides at an angle $\alpha$ in the range mentioned above to improve the massaging effect on the gums.

Additionally or alternatively, in the direction in which the toothbrush is pushed the bristles 6 should have an angle of inclination $\beta$ backward and forward seen from the middle of the web in the range mentioned above to improve the cleaning effect. At maximum, the length of the bristles 6 may be such that the bristles touch one another. It has also proven to be of advantage for a bristle holder, e.g. bristle holder 3, to have a softer type of bristle 6 than the other bristle holder 4. The softer bristles are e.g. preferably used for cleaning the inside of the teeth.

An essential feature of the embodiment according to the present invention is the provision of notches 5 in the bristle holders 3 and 4. They are arranged in the direction of pushing along the web 2, but on the outside. At least two notches 5 are provided, but a larger number is also expedient. The purpose of these notches 5 is to enable the bristle holders 3 and 4 to adapt elastically to teeth of different thicknesses by rotating about axis 8.

Moreover, by weakenings of the material rated flexure points 9 are provided near the web 2 in handle 1 that enable the web 2, and therewith bristle holders 3, 4, to pivot about the axis 7 extending parallel to the axis of the body. The bristle holders thereby more easily adapt to different individual jaw curvatures.

Of very special significance for the toothbrush according to the present invention with its pushing and massaging action is the rounding off of the bristle tips, which as such has become known through toothbrushes of other designs, to avoid injury to the gums.

In addition to bristles being provided on the bristle holders 3, 4, which in usage are in a vertical position, bristles 6' can also advantageously be provided on the web 2 in the known manner to simultaneously clean the chewing surface of the teeth.

We claim:

1. A toothbrush for the simultaneous all round cleaning and brushing of the upper and lower rows of teeth of a person's mouth, comprising a bristle holder and a handle, said handle being connected to said bristle holder through a flexible connection means permitting relative rotation between said handle and said bristle holder, said bristle holder including a central web from which first and second limbs extend so that the bristle holder is substantially H-shaped in cross-section, said limbs having surfaces substantially facing each other and having bristles extending from said surfaces of said respective limbs at an angle to said central web within the range of 1 to about 10°, said handle and said central web lying substantially in the same plane, said connection means being provided by a weakening of the material comprising said connection means between said handle and said central web so as to provide elastic rotation of said bristle holder about an axis parallel to the teeth, thereby enabling said bristle holder to more easily adapt to different individual jaw curvatures.

2. The toothbrush as claimed in claim 1 where at least some of said bristles extending from said respective limbs have an additional inclination of from about 3° to about 15° in a plane extending parallel to the plane of said central web.

3. The toothbrush as claimed in claim 1 in that at least some of the bristles extending from one of said limbs are softer than those in the other of said limbs.

* * * * *